United States Patent [19]

Lunn

[11] Patent Number: 4,833,850

[45] Date of Patent: May 30, 1989

[54] END PROTECTOR FOR A REINFORCING BAR

[76] Inventor: John E. Lunn, 131 Victoria Street, Alliston, Ontario, Canada, L0M 1A0

[21] Appl. No.: 133,891

[22] Filed: Dec. 16, 1987

[51] Int. Cl.[4] ..... B65D 59/06

[52] U.S. Cl. ..... 52/301; 52/687; 138/96 R; 138/96 T

[58] Field of Search ..... 52/244, 301, 677, 687–689; 138/96 R, 96 T; D8/386, 349, 354, 384; 135/82–86

[56] References Cited

U.S. PATENT DOCUMENTS

| | | | |
|---|---|---|---|
| D. 237,628 | 11/1975 | Russo | 52/301 X |
| 4,202,378 | 5/1980 | Bush et al. | 138/96 R |
| D. 262,093 | 12/1981 | Bush et al. | 52/687 X |
| 254,348 | 2/1882 | Maine | 135/86 |
| 4,644,726 | 2/1987 | Wheeler | 52/687 X |
| 4,694,863 | 9/1987 | Klopp | 138/96 R |

*Primary Examiner*—David A. Scherbel
*Assistant Examiner*—Richard E. Chilcot, Jr.
*Attorney, Agent, or Firm*—Daryl W. Schnurr

[57] ABSTRACT

An end protector for a reinforcing bar has a one piece support and a cushion. The support has a cylindrically-shaped receptacle with two arms extending outwardly therefrom and two longitudinal slots that are generally opposed to one another along either side of the receptacle. The arms hold the cushion in position on a side of said receptacle opposite to the reinforcing bar. When an external force is exerted on the cushion, at least part of the force is transferred through said arms to said receptacle, thereby causing the slots to narrow and the receptacle to further tighten onto said rebar. When the external force is removed, the support returns to its initial position. Thus, when no external force is exerted onto the protector, it can be easily installed or removed from an end of the reinforcing bar.

10 Claims, 1 Drawing Sheet

END PROTECTOR FOR A REINFORCING BAR

BACKGROUND OF THE INVENTION

1. Field of the Invention

This invention relates to an end protector for a reinforcing bar and the like.

2. Description of the Prior Art

Protectors or caps for reinforcing bars (also sometimes referred to as re-bars or reinforcing rods) are known, two such protectors being described in Canadian Patent Nos. 663,752 and 1,085,643. Unfortunately, the previous protectors are too complex, too expensive to manufacture, too difficult to install and remove on the reinforcing bars, too heavy or too bulky and they have not been widely used, if at all, during construction. There is very little concrete work done today without reinforcing bars. When a floor or wall of concrete is formed, reinforcing bars, often one to one and a half feet apart extend partially out of the wall or floor. When the concrete hardens, the bars are held rigidly usually at an angle towards the vertical. Often, the bars remain in this exposed condition for many days while other work is completed on the construction side. If a worker falls onto the rods, he can be seriously injured.

SUMMARY OF THE INVENTION

It is therefore an object of the present invention to provide an end protector for reinforcing bars that is inexpensive to manufacture, light-weight and re-useable, yet durable enough to provide a significant level of safety.

A protector for use with a reinforcing bar has a receptacle for receiving an exposed end of the reinforcing bar. The receptacle has a cylindrical shape and is sized to fit snugly over said end. The receptacle has two arms extending outward therefrom, said arms having a cushion in place on a side of said receptacle opposite to said reinforcing bar. The arms are firm but somewhat flexible and resilient so that, when an external force is exerted on said cushion, part of said force is transferred to said receptacle through said arms to cause a receptacle to further tighten onto said end. The protector is easily removable from said end when no external force is exerted onto said arms.

Preferably, the receptacle has two longitudinal slots therein, said slots being generally opposed to one another and extending to an open face of said receptacle, said slots being located between said arms which are also generally opposed to one another.

In a variation of the invention, a protector for use with a reinforcing bar has a one piece support and a cushion, said support having a receptacle for receiving an exposed end of the reinforcing bar with two arms extending outward therefrom. The receptacle has a cylindrical shape and is sized to fit snugly over said end. The arms are generally opposed to one another and holds said cushion against said receptacle on a side opposite to said reinforcing bar. The arms are firm but somewhat flexible and resilient so that when an external force is exerted on said cushion part of said force is transferred to said receptacle through said arms to cause the receptacle to further tighten onto said end. The protector is easily removable from said end when no external force is exerted onto said arms.

BRIEF DESCRIPTION OF THE DRAWINGS

In drawings which illustrate a preferred embodiment of the invention.

DESCRIPTION OF A PREFERRED EMBODIMENT

Figure 1:
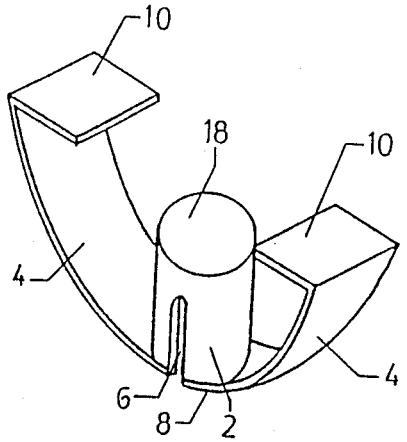
FIG. 1 is a perspective view of a receptacle and arms.

Referring to FIG. 1 in greater detail, the receptacle 2 has a cylindrical shape and has two arms 4 that extend outward therefrom. The receptacle has two longitudinal slots 6, only one of which is shown in FIG. 1, said slots being generally opposed to one another and extending to an open face 8 of the receptacle 2. Each of the arms 4 has an inwardly extending flange 10 at a free end thereof.

Figure 2:
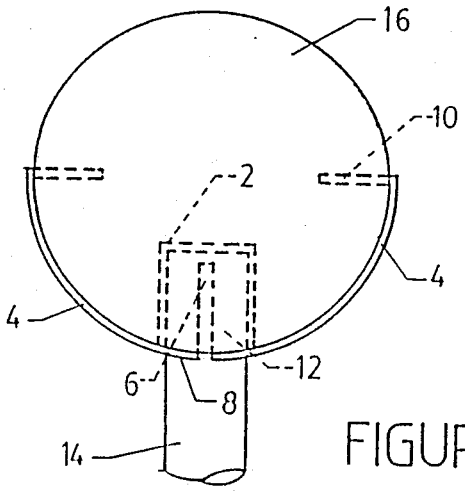
FIG. 2 is a side view of a protector installed on top of a reinforcing bar.
Figure 3:
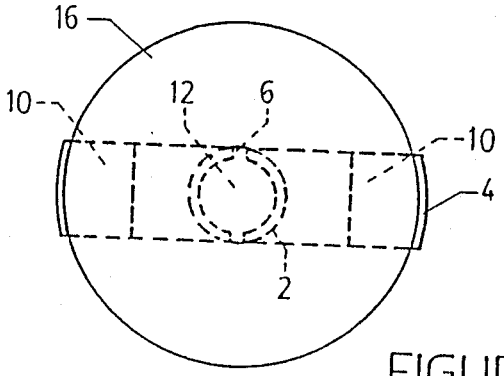
FIG. 3 is a top view of the protector of FIG. 1.

In FIGS. 2 and 3, it can be seen that the receptacle 2 fits snugly over an end 12 of a reinforcing bar 14 (only part of which is shown in FIG. 2). A cushion 16 is held in place on a side of the receptacle 2 opposite to the reinforcing bar 14 by the arms 4. The arms 4 extend on either side of said cushion 16 substantially half-way around said cushion. Preferably, the cushion 16 is a ball and still more preferably, is a sponge ball.

The flanges 10 on the arms 4 extend into suitable slits (not shown) in the ball 16 to retain said ball in position relative to said arms and said receptacle. The ball 16 has a cylindrically-shaped opening therein to receive said receptacle 2 and said arms extend from said receptacle, adjacent to a face of said opening and curve smoothly in a circular arc adjacent to an outer surface of said ball. The arms 4 extend on either side of the cushion 16.

Preferably, the receptacle 2, arms 4 and flanges 10 are made of spring steel and the ball 16 is made of sponge rubber. The arms 4 are firm, but somewhat flexible and resilient, so that, when an external force is exerted on the ball, at least part of this force is transferred to said receptacle 2 through said arms 4 to cause the receptacle 2 to further tighten onto said end 12. This causes the interior sides of the receptacle 2 to engage the corresponding sides of the end 12 and assists in holding the protector on the reinforcing bar. Also, it absorbs some of the force of the protector against an upper surface 18 of the receptacle 2. Thus, the receptacle 2 can have thinner walls and therefore be lighter in weight than would otherwise be feasible.

The protector of the present invention is made of two pieces, the receptacle, arms and tabs being a one piece support and the ball being the second piece. If a construction worker were to fall on the protector of the present invention, the force of the construction worker would cause the bar to exert downward and outward pressure onto the arms 4 and receptacle 2. This in turn will cause the arms to exert inward pressure on the receptacle 2, causing the slots 6 to shrink slightly in width. The result is that the interior sides of the receptacle squeeze tighter against the end of the bar 14. The external force is thus distributed through the upper surface and sides of the receptacle, making it less likely that the reinforcing bar will break through the upper surface of the receptacle. When the external force is removed, the receptacle 2, arms 4 and flanges 10 return to their original position as shown in FIG. 1. Thus, when a worker is exerting force onto the cushion of the present invention, the protector is held in its tightest position on the rebar, thereby hopefully preventing the worker from coming into contact with the sharp end of the reinforcing bar. On the other hand, when no external force is exerted onto the protector, the protector simply fits snugly onto the end of the rebar and can be installed and removed easily.

Preferably, the ball is made of sponge and the receptacle, arms and flanges are made of spring steel. Preferably, the ball is brightly coloured so that it can easily be seen by the workers on a construction site. The pressure of the arms 4 onto the receptacle 2 when an external force is being exerted on the ball 16 assists in preventing the rod from tearing through the upper surface 18 of the receptacle 2.

If it is desired to remove the ball 16 from the receptacle 2, arms 4 and flanges 10, the ball can simply be squeezed from each side to remove it from the flanges 10 and then lifted off the receptacle 2. Replacement of the ball maybe necessary if the ball is damaged or if the receptacle, arms or flanges are damaged. The protector of the present invention is easily reuseable as it slips quite easily onto and off of the end of the reinforcing bar when no external force has been applied to it.

What I claim as my invention is:

1. A protector for use with a reinforcing bar, said protector comprising a receptacle for receiving an exposed end of the reinforcing bar, said receptacle having a cylindrical shape and being sized to fit snugly over said end, said receptacle having two arms extending outward therefrom, said arms holding a cushion in place on a side of said receptacle opposite to said reinforcing bar, said arms being firm but somewhat flexible and resilient so that, when an external force is exerted on said cushion, part of said force is transferred to said receptacle through said arms to cause the receptacle to further tighten onto said end, said protector being easily removable from said end when no external force is exerted onto said arms.

2. A protector as claimed in claim 1 wherein the receptacle has two longitudinal slots therein, said slots being generally opposed to one another and extending to an open face of said receptacle, said slots being located between said arms which are also generally opposed to one another.

3. A protector as claimed in claim 2 wherein said arms extend one either side of the cushion.

4. A protector as claimed in claim 3 wherein the cushion ia a ball.

5. A protector as claimed in claim 4 wherein the ball has a cylindrically-shaped opening therein to receive said receptacle and said arms extend from said receptacle adjacent to a face of said opening and curve smoothly in a circular arc adjacent to an outer surface of said ball.

6. A protector as claimed in claim 5 wherein each arm has an inwardly extending flange at a free end thereof, said flanges extending into said ball to retain said ball in position relative to said arms and said receptacle.

7. A protector as claimed in claim 6 wherein the arms extend substantially halfway around said ball.

8. A protector as claimed in claim 7 wherein the receptacle and arms are made of spring steel so that the arms will return to their initial position when there is no external force exerted upon them.

9. A protector as claimed in claim 8 wherein the ball is made of sponge rubber.

10. A protector for use with a reinforcing bar, said protector comprising a one piece support and a cushion, said support having a receptacle for receiving an exposed end of the reinforcing bar with two arms extending outward therefrom, said receptacle having a cylindrical shape and being sized to fit snugly over said end, said arms being generally opposed to one another to hold said cushion against said receptacle on a side opposite to said reinforcing bar, said arms being firm but somewhat flexible and resilient so that when an external force is exerted on said cushion, part of said force is transferred to said receptacle through said arms to cause the receptacle to further tighten onto said end, said protector being easily removable from said end when no external force is exerted onto said arms.

* * * * *